United States Patent [19]

Clark

[11] 4,440,261

[45] Apr. 3, 1984

[54] PORTABLE HIGH-RISE ESCAPE DEVICE

[76] Inventor: Mark J. Clark, 29 Brainerd Rd., Branford, Conn. 06405

[21] Appl. No.: 208,877

[22] Filed: Nov. 21, 1980

[51] Int. Cl.[3] ..... A62B 1/02

[52] U.S. Cl. ..... 182/3; 182/82; 182/142

[58] Field of Search ..... 182/3, 231, 233, 234, 182/73, 236, 238, 239, 71, 82, 142

[56] References Cited

U.S. PATENT DOCUMENTS

| | | | |
|---|---|---|---|
| 187,569 | 2/1877 | Tixier | 182/71 |
| 295,047 | 3/1884 | Parrott | 182/236 |
| 701,094 | 5/1902 | Setbacken | 182/239 |
| 1,233,540 | 7/1917 | Astaritas | 182/71 |
| 1,254,103 | 1/1918 | Wolfe | 182/60 |
| 2,629,531 | 2/1953 | Hakkarinen | 182/73 |
| 3,844,377 | 10/1974 | Wilkins | 182/73 |

FOREIGN PATENT DOCUMENTS

| | | | |
|---|---|---|---|
| 106478 | 2/1943 | Sweden | 182/3 |

*Primary Examiner*—Reinaldo P. Machado
*Attorney, Agent, or Firm*—DeLio and Libert

[57] ABSTRACT

A portable high-rise escape device for attachment to the windowsill of a tall building is disclosed comprising a telescoping length extendible boom, an actuable pneumatic driver for extending the boom, a detachable wall mounting bracket to securely connect the boom to a windowsill, a length of cable having a harness at one end, a winch to contain and release the cable at a predetermined rate, and cable guides to guide the cable from the winch to the end of the boom.

7 Claims, 5 Drawing Figures

PORTABLE HIGH-RISE ESCAPE DEVICE

BACKGROUND OF THE INVENTION

This invention relates to high-rise escape devices and more particularly to a portable, foldable, high-rise escape device that provides actuable telescopic extension.

Prior escape devices for use in a high-rise environment were not portable or stowable so as to allow safe ready egress from a high-rise building when needed yet allow compact stowability at other times.

SUMMARY OF THE INVENTION

A portable high-rise escape device is disclosed comprising a telescoping length extendible boom, an actuable driver for extending the boom, a detachable wall mounting bracket connected to the boom for secure attachment to a windowsill, a length of cable having a harnes at one end and connected to a winch at the other end with the winch being adapted to release the cable at a predetermined rate, and cable guides to guide the cable from the winch to the end of the boom.

The telescoping length extendible boom is comprised of a plurality of interconnected tube members which extend to full length upon actuation of the driver. The driver may be a canister contained within the boom to pneumatically drive and extend the boom upon actuation. The boom telescopes into a compact length and the wall mounting bracket is foldable into a stowable configuration.

It is a principal object of this invention to provide an improved portable stowable high-rise escape device.

A further object of the invention is to provide a high-rise escape device that is automatically extendible upon actuation.

A still further object of the invention is to provide a high-rise escape device having a telescoping length extendible boom.

A still further object of the invention is to provide a high-rise escape device that detachably secures to a windowsill in operation and folds into a compact configuration for storage.

A still further object of the invention is to provide a portable high-rise escape device that provides a gradual descent from a high-rise environment.

A still further object of the invention is to provide a high-rise escape device that is economical to manufacture, durable in use and refined in appearance.

DESCRIPTION OF THE PREFERRED EMBODIMENT

Figure 1:
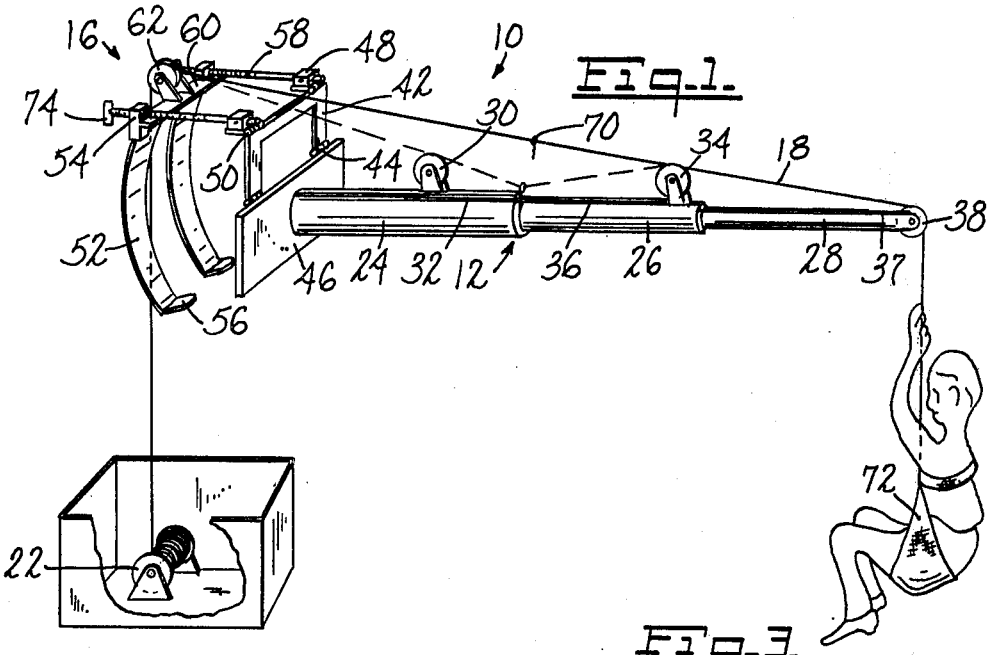
FIG. 1 is a perspective partially diagrammatic view of the invention.

The portable high-rise escape device of this invention is generally designated by the numeral 10 and is shown in an operational position in FIG. 1. Escape device 10 comprises a telescoping extendible boom assembly 12 (FIG. 3), an actuable driver canister 14, a detachable wall-mounting bracket assembly 16 (FIG. 2), a length of cable 18, cableguide assembly 20, and winch 22.

Figure 3:
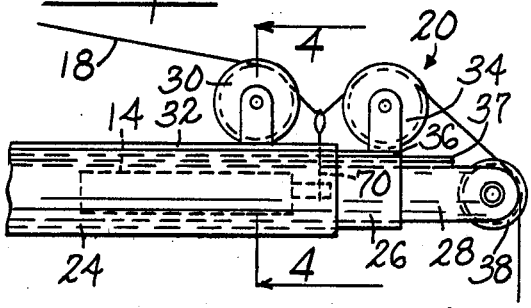
FIG. 3 is an enlarged partial view of the outer end of the boom.
Figure 4:
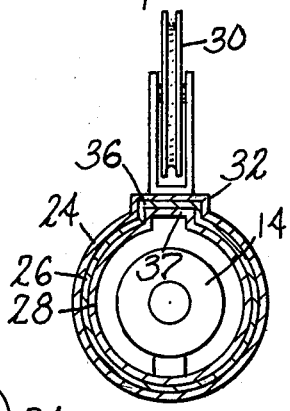
FIG. 4 is an enlarged sectional view seen on line 4—4 of FIG. 3.

Boom assembly 12 is a length extending, telescoping assembly of concentrically oriented interconnected tube elements 24, 26, 28. Outer tube element 28 and middle tube element 26 telescope into main tube element 24 to form a compact configuration as shown in FIG. 3. Interlocking ridges 32, 36, 37 of respctive tube elements 24, 26, 28 prevent angular movement of the tube elements (FIG. 4). Cableguide 30 is secured to ridge 32 of main tube element 24 and cableguide 34 is secured to ridge 36 of middle tube element 26. Cableguide 38 is secured to the outer end of tube element 28.

Figure 2:
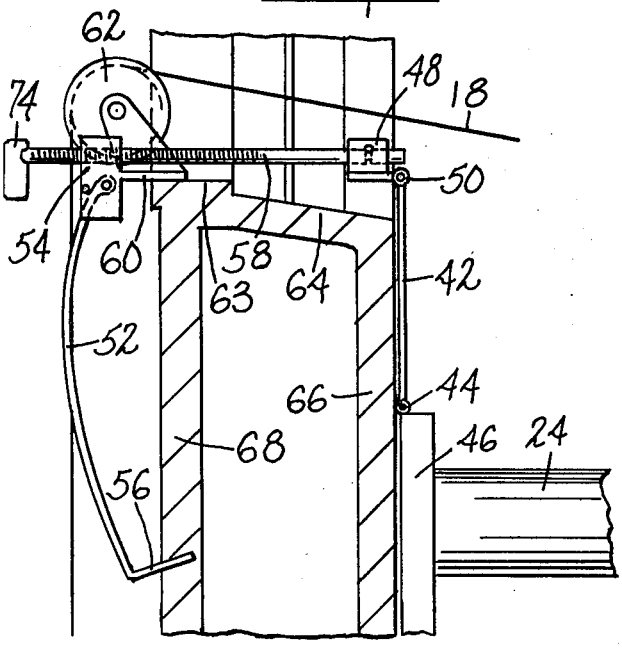
FIG. 2 is an enlarged sectional view of the wall mounting bracket.
Figure 5:
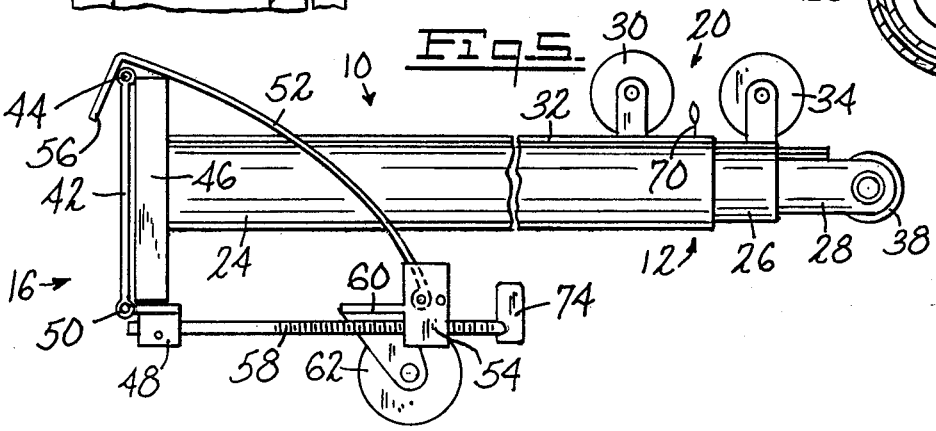
FIG. 5 is a partially cut-away view of the invention in a stowable configuration.

Wall mounting bracket assembly 16 is comprised of a first frame element 42 connected by hinges 44 to wall plate 46 (FIG. 1). Main tube element 24 is rigidly secured to wall plate 46. Studs 48 are connected to frame element 42 by hinges 50 (FIG. 2). Second frame element or tongs 52 are in spaced apart disposition to frame 42 and pivotally connected to studs 54 (FIG. 5). Each tong element 52 has a lip 56 at one end to aid in gripping a wall.

Studs 54 and cableguide 62 are mounted to transverse bar 60. Studs 54 contain a threaded bore to receive threaded shaft 58. Shaft 58 is rotatibly mounted to studs 48 such that rotation of shaft 58 varies the spaced apart disposition of tongs 52 with respect to frame element 42.

In a mounted position (FIG. 2), frame 42 and wallplate 46 abut outer building wall 66 and tongs 52 engage inner building wall 68. Transverse bar 60 rests upon stool 63 of windowsill 64 and shaft 58 traverses sill 64. The rotation of shaft 58 thus carries tongs 52 and lip 56 into engagement with inner wall 68 to securely mount bracket 16 to the building.

Actuable driver means or driver canister 14 is mounted within the concentric orientation of tubes 24, 26, 28 as shown in FIGS. 3 and 4. Canister 14 functions to drive tubes 26 and 28 into the extended position of FIG. 1 in a known manner upon the required movement of canister actuating pin 70. Cable 18 is connected to actuating pin 70 between guides 30 and 34 such that the lowering of an individual into harness 72 will cause cable 18 to pull upon pin 70 thereby actuating canister 14 to automatically extend boom assembly 12.

Cable 18 is connected to harness 72 at one end and is wound about winch 22 at the other end. Winch 22 is an automatic rewind, geared release type winch to control the rate of descent of the individual to a predetermined rate. Upon the individual reaching the ground and dismounting harness 72, winch 22 automatically rewinds cable 18 to allow for the escape of others.

In a stowage configuration, tubes 26, 28 are telescoped into tube 24 as shown in FIG. 3. Plate 46 is pivoted clockwise about hinge 44, shaft 58 is pivoted counterclockwise about hinge 50, and tongs 52 are pivoted counterclockwise about studs 54 to the position shown in FIG. 5. Tube 24 is thus disposed between tongs 52 to form the compacted folded position of FIG. 5. This compacted configuration allows convenient storage of this high-rise escape device without sacrificing strength or ease of operation.

In operation, device 12 is unfolded from the configuration of FIG. 5 and placed over windowsill 64 as shown in FIG. 2. Hinges 50 and the pivotal mounting of tongs 52 to studs 54 are of the jam-lock type to limit the angle of pivotal movement. Shaft 58 is rotated by handle 74 to securely tighten escape device 10 to the wall.

Lips 56 aid in gripping wall 68 while the weight of plate 46 also provides stability. Upon the securement of device 10 to windowsill 64, the individual lowers himself into harness 72 thereby actuating canister 14 by pin 70. Upon actuation, canister drive 14 extends tubes 26, 28 automatically into the position of FIG. 1. The weight of the individual causes winch 22 to release and thereafter control the descent of the individual to the gound. Upon reaching the ground and dismounting from harness 72, winch 22 rewinds cable 18 in a conventional manner to bring harness 72 back up for further operation. Furthermore, high-rise escape device 10 is of sturdy construction so as to be utilized from great heights while telescoping extension allows utilization in modern high-rise buildings.

Thus it can be seen that this device accomplishes at least all of its stated objectives.

What I claim is:

1. A portable high-rise escape device comprising, a telescoping length extendible boom, actuable driver means for extending said boom comprising a cannister means connected to said boom to pneumatically extend said boom, a detachable wall mounting bracket with said boom being connected to said bracket, a length of cable having a harness at one end, actuator means responsive to a predetermined movement of said cable for actuating said cannister, winch means to release said cable at a predetermined rate, said cable being partially contained on said winch means, and guide means to guide said cable from said winch means to the outer end of said boom, said guide means being mounted to said boom.

2. A portable high-rise escape device comprising, a telescoping length extendible boom, actuable driver means for extending said boom comprising a cannister means connected to said boom to pneumatically extend said boom, a detachable wall mounting bracket with said boom being connected to said bracket, a length of cable having a harness at one end, said cannister means having an actuating pin connected to said cable so that a predetermined movement of said cable actuates said cannister, winch means to release said cable at a predetermined rate, said cable being partially contained on said winch means, and guide means to guide said cable from said winch means to the outer end of said boom, said guide means being mounted to said boom.

3. A portable high-rise escape device comprising, a telescoping length extendible boom, actuable driver means for extending said boom, a detachable wall mounting bracket with said boom being connected to said bracket, a length of cable having a harness at one end, winch means to release said cable at a predetermined rate, said cable being partially contained on said winch means, and guide means to guide said cable from said winch means to the outer end of said boom, said guide means being mounted to said boom, said wall mounting bracket comprising a first frame element adapted to engage the outer wall of a building, a second frame element adapted to engage the inner wall of a building, said first frame element being in spaced apart disposition to said second frame element, a third frame element connecting said first and second frame elements and adapted to traverse a wall of a building, first hinge means pivotally connecting said first frame element and said third frame element, and second hinge means pivotally connecting said second frame element and said third frame element.

4. The device of claim 3 wherein said third frame element comprises an elongated threaded shaft rotatably connected to said first frame element and threadably connected to said second frame element so that rotation of said shaft varies the distance between said first frame member and said second frame member.

5. The device of claim 3 comprising, means for detachably securing said first and second frame elements to the wall of a building.

6. The device of claim 3 wherein said first and second hinge means each comprise a jam lock element to restrict rotation of said hinge means.

7. A protable high-rise device comprising, a telescoping length extendible boom, actuable driver means for extending said boom, a detachable wall mounting bracket with said boom being connected to said bracket, a length of cable having a harness at one end, winch means to release said cable at a predetermined rate, said cable being partially contained on said winch means, and guide means to guide said cable from said winch means to the outer end of said boom, said guide means being mounted to said boom, said wall mounting bracket comprising, a first frame element adapted to contact the outer wall of a building, a second frame element adapted to grip the inner wall of a building, and means for compressing said second frame element against the inner wall of a building, said first frame element comprising a plate with said boom being attached to said plate, and said second frame element comprising a plurality of downwardly extending tong elements.

* * * * *